United States Patent [19]

Rosenberg et al.

[11] 4,231,685

[45] Nov. 4, 1980

[54] ROOF SUPPORT UNIT

[75] Inventors: Harry Rosenberg, Lüdinghausen; Lubomir Plevak, Lünen, both of Fed. Rep. of Germany

[73] Assignee: Gewerkschaft Eisenhutte Westfalia, Lünen, Fed. Rep. of Germany

[21] Appl. No.: 630

[22] Filed: Jan. 2, 1979

[30] Foreign Application Priority Data

Jan. 2, 1978 [DE] Fed. Rep. of Germany ..... 2800004

[51] Int. Cl.[3] ..... E21D 15/44

[52] U.S. Cl. ..... 405/296; 405/299

[58] Field of Search ..... 405/291, 296, 299, 300, 405/301; 91/170 MP; 248/357; 299/33

[56] References Cited

U.S. PATENT DOCUMENTS

| | | | |
|---|---|---|---|
| 4,065,930 | 1/1978 | Spies | 405/296 |
| 4,094,155 | 6/1978 | Blumenthal et al. | 405/296 |
| 4,132,081 | 1/1979 | Walker et al. | 405/296 |
| 4,140,430 | 2/1979 | Blumenthal et al. | 405/291 |

*Primary Examiner*—David H. Corbin

*Attorney, Agent, or Firm*—Sughrue, Rothwell, Mion, Zinn and MacPeak

[57] ABSTRACT

A roof support unit for use in a mineral mining working has a roof shield supported on a floor sill by means of at least two hydraulic props. A goaf shield is pivotally linked to both the roof shield and the floor sill. At least one of the hydraulic props is inclined towards the face-side of the unit and engages the roof shield. At least one of the hydraulic props is inclined towards the goaf-side of the unit and engages the roof shield.

8 Claims, 4 Drawing Figures

ROOF SUPPORT UNIT

BACKGROUND OF THE INVENTION

This invention relates to a roof support unit for use in a mineral mining working.

The roof of a mineral mining working, such as a longwall working, is usually supported by a roof support assembly constituted by a plurality of roof support units positioned side-by-side along the working. Typically each of the roof support units has a roof shield supported by means of hydraulic props on a floor sill. A goaf shield is provided between the floor sill and the roof shield at the goaf ends thereof.

When such a roof support unit is to be used to support the roof of a mine working of varying seam height, it is necessary for the props of the unit to be able to support the roof over a relatively wide range of seam heights. One way of accomplishing this, without having very large props, is to incline one or more of the props towards the face being won, and one or more of the props towards the goaf side of the working. In known arrangements of this kind, the prop(s) inclined towards the face engage the roof shield, whereas the prop(s) inclined towards the goaf side of the working engage the goaf shield. Although such an arrangement results in sufficient roof supporting force to be achieved over the desired range of seam heights, it suffers from the disadvantage that the forces acting on the goaf shield impose an extremely heavy load on the link between the goaf shield and the roof shield. Moreover, use must be made of props of different lengths which is detrimental from the point of standardisation of equipment. Furthermore, the goaf shield is used to support part of the force exerted by the roof of the working which is not desirable as the goaf shield is designed only to support the loads imposed by falling rubble. (A typical roof support unit of this kind is described in DT-Gbm No. 7602845).

The aim of the invention is to provide a roof support unit for use with seams of varying height and which does not suffer from these disadvantages.

SUMMARY OF THE INVENTION

The present invention provides a roof support unit for use in a mineral mining working, the roof support unit having a roof shield supported on a floor sill by means of at least two hydraulic props, a goaf shield being pivotally linked to both the roof shield and the floor sill, at least one of the hydraulic props being inclined towards the face-side of the unit and engaging the roof shield, and at least one of the hydraulic props being inclined towards the goaf-side of the unit and engaging the roof shield.

Direct engagement of the inclined props with the roof shield enables props of the same length to be used. Moreover, the roof load is transmitted directly from the roof shield to the floor sill, and not through the goaf shield. Moreover, this unit can support heavy loads even when the props are retracted for winning material from very thin seams. During extension and retraction of the props, the face-side end of the roof shield moves substantially vertically so that the roof can always be completely supported.

In one preferred embodiment, there are three hydraulic props, two of the props being inclined towards the face-side of the unit and the other prop being inclined towards the goaf-side of the unit, said other prop being positioned between said two props. In another preferred embodiment, there are four hydraulic props, two of the props being inclined towards the face-side of the unit and two being inclined towards the goaf-side of the unit, the two props inclined towards the goaf-side being positioned between the two props inclined towards the face-side. This four-prop arrangement is used where the roof support unit needs to be wider than that having three props. It enables larger loads to be supported and ensures that the horizontal force components cancel one another out because of the symmetrical arrangement of the props with respect to the roof shield.

Advantageously, the or each prop inclined towards the goaf-side of the unit is pivotally attached to the roof shield at a point which is nearer the goaf-side of the unit than the axis of the pivotal linkage between the goaf shield and the roof shield. Preferably, the or each prop inclined towards the goaf-side of the unit passes through an aperture in the goaf shield.

The or each prop inclined towards the goaf-side of the unit may be pivotally attached to the floor sill at a point nearer the face-side of the unit than that at which the or each prop inclined towards the face-side is pivotally attached.

Preferably, the or each prop inclined towards the face-side of the unit is pivotally attached to the roof shield at a point substantially vertically above the face-side end of the floor sill.

Advantageously, the props inclined in the same direction are attached to the roof shield at points on a line extending parallel to the face, and are attached to the floor sill at points on a line extending parallel to the face.

All the props may be inclined to the vertical at substantially the same angle, and all the props may be substantially identical.

BRIEF DESCRIPTION OF DRAWINGS

Two forms of mine roof support unit, each constructed in accordance with the invention, will now be described, by way of example, with reference to the accompanying drawings, in which.

DESCRIPTION OF PREFERRED EMBODIMENTS

Figure 1:
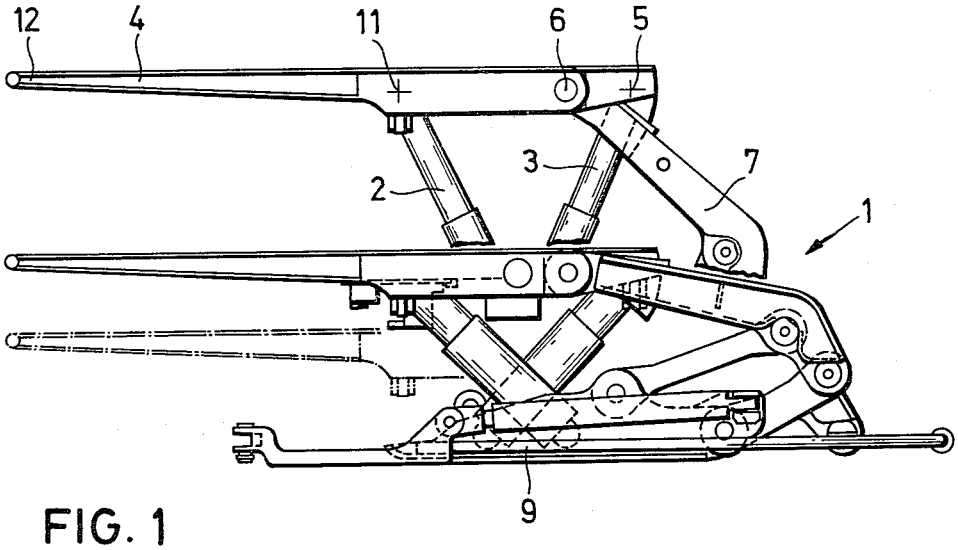
FIG. 1 is a side elevation of the first form of roof support unit.
Figure 2:
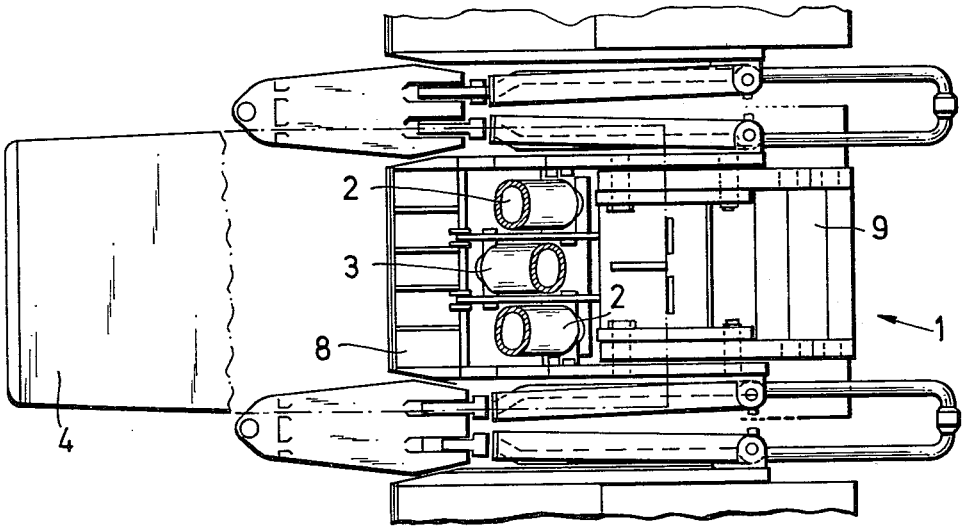
FIG. 2 is a plan view of the roof support unit of FIG. 1.

Referring to the drawings, FIGS. 1 and 2 show a roof support unit, indicated generally by the reference numeral 1, having a roof shield 4 supported on a floor sill 9 by means of three hydraulic props 2,3. This unit is, therefore, a "three-prop" unit. The three props 2,3 are identical, but the two outer props 2 are inclined towards the coal face (not shown) whereas the central prop 3 is inclined towards the goaf-side of the working. A goaf shield 7 is pivotally linked, at 6, to a point adjacent to the goaf-side end of the roof shield 4. The goaf shield is also linked at the goaf-side end of the floor sill 9.

The two outer props 2 are mounted on the floor sill by means of articulated foot joints (not shown) of known construction, at positions nearer the goaf-side of the floor sill than the position at which the central prop 3 is mounted (also by an articulated foot joint of known construction) on the floor sill. All the foot joints are such as to permit the props 2,3 to pivot in a vertical plane perpendicular to that of the face. The prop 3 passes through a hole (shown by chain lines in FIG. 1) in the goaf shield 7 and is pivotally attached to the roof shield 4 at a point 5 at the goaf-side end of the roof shield. The props 2 are likewise pivotally attached to the roof shield 4, but at points 11 which are situated substantially vertically above the face-side end 8 of the floor sill 9. The roof support unit 1 is such that the face-side end 12 of the roof shield 4 moves substantially vertically when the props 2 and 3 are extended or retracted to raise or lower the roof shield.

Figure 3:
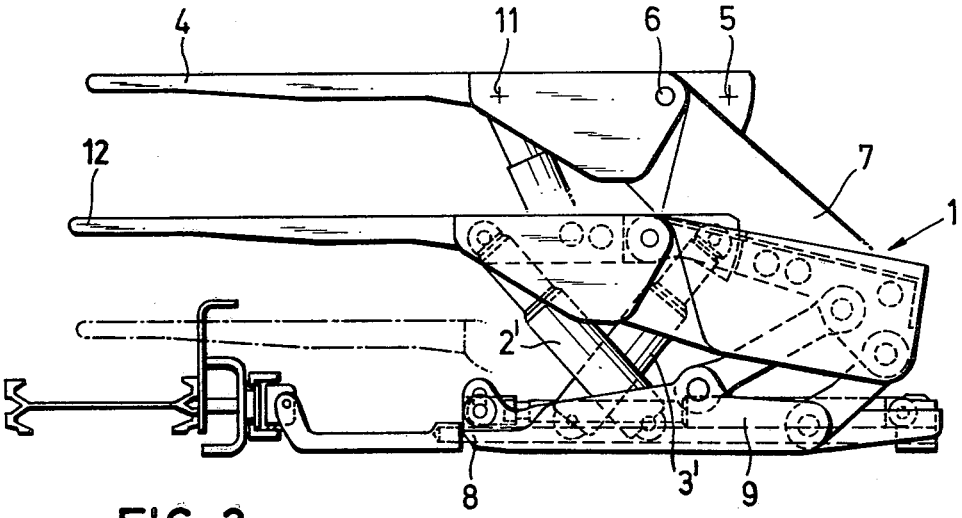
FIG. 3 is a side elevation of the second form of roof support unit.
Figure 4:
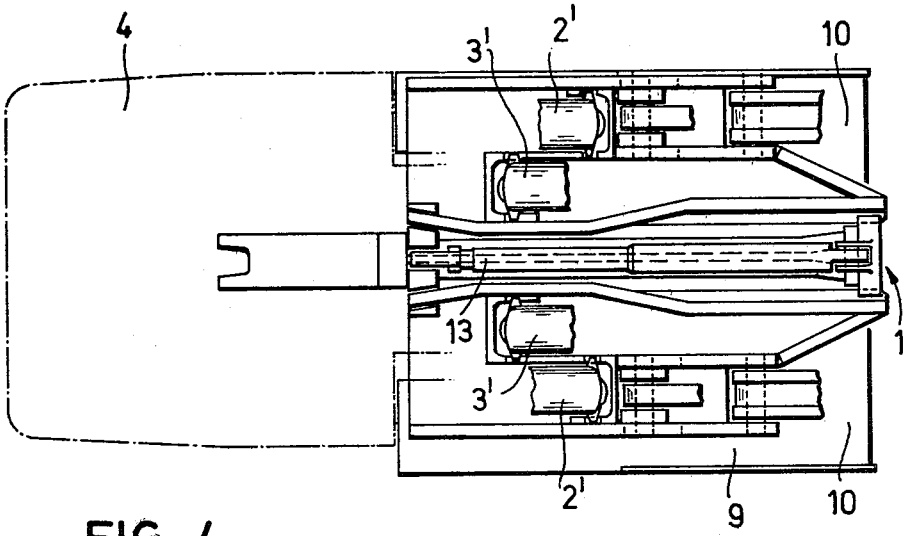
FIG. 4 is a plan view of the roof support unit of FIG. 3.

The roof support unit shown in FIGS. 3 and 4 is very similar to that of FIGS. 1 and 2, and like reference numerals have been used for like parts. The basic difference between this unit and that of FIGS. 1 and 2 is that this unit has two outer props 2' inclined towards the face, and two central props 3' inclined towards the goaf-side of the working. This unit is, therefore, a "four prop" unit. Here again, the central props 3' extend through holes in the goaf shield 7. The only other difference between this unit and that of FIGS. 1 and 2 is that this unit has a floor sill 9 constructed by a pair of floor girders 10, an advance mechanism 13 being provided between the floor girders for advancing the unit to follow up the advance of the coal face. A similar advance mechanism (not shown) is, of course, provided for the unit of FIGS. 1 and 2.

We claim:

1. A roof support unit for use in a mineral mining working, comprising:

(a) a roof shield supported on a floor sill by means of at least two hydraulic props, (b) a goaf shield pivotally linked to both the roof shield and the floor sill, (c) at least one of the hydraulic props being inclined towards a face-side of the unit and pivotally engaging the roof shield, (d) at least another one of the hydraulic props being:

(1) oppositely inclined towards a goaf-side of the unit, (2) pivotably attached to the roof shield at a point nearer the goaf-side thereof than the axis of the pivotal linkage between the goaf shield and the roof shield, and (3) passing through an aperture in the goaf shield, and (e) said at least one prop and said at least another one prop crossing between their ends.

2. A roof support unit according to claim 1, wherein there are three hydraulic props, two of the props being inclined towards the face-side of the unit, and the other prop being inclined towards the goaf-side of the unit, said other prop being positioned between said two props.

3. A roof support unit according to claim 1, wherein there are four hydraulic props, two of the props being inclined towards the face-side of the unit and two being inclined towards the goaf-side of the unit, the two props inclined towards the goaf-side being positioned between the two props inclined towards the face-side.

4. A roof support unit according to claim 1, wherein the prop inclined towards the goaf-side of the unit is pivotally attached to the floor sill at a point nearer the face-side of the unit than that at which the prop inclined towards the face-side is pivotally attached.

5. A roof support unit according to claim 1, wherein the prop inclined towards the face-side of the unit is pivotally attached to the roof shield at a point substantially vertically above the face-side end of the floor sill.

6. A roof support unit according to claim 1, wherein any props inclined in the same direction are attached to the roof shield at points on a line extending parallel to the face, and are attached to the floor sill at points on a line extending parallel to the face.

7. A roof support unit according to claim 1, wherein all the props are inclined to the vertical at substantially the same angle.

8. A roof support unit according to claim 1, wherein all the props are substantially identical.

* * * * *